US009694225B2

(12) United States Patent
Toback et al.

(10) Patent No.: US 9,694,225 B2
(45) Date of Patent: Jul. 4, 2017

(54) EXERCISE APPARATUS

(71) Applicant: SPROING FITNESS LLC, Bannockburn, IL (US)

(72) Inventors: Paul Toback, Bannockburn, IL (US); Steve Lenz, Naperville, IL (US)

(73) Assignee: SPROING FITNESS LLC, Bannockburn, IL (US)

( * ) Notice: Subject to any disclaimer, the term of this patent is extended or adjusted under 35 U.S.C. 154(b) by 0 days.

(21) Appl. No.: 15/206,003

(22) Filed: Jul. 8, 2016

(65) Prior Publication Data

US 2016/0317851 A1 Nov. 3, 2016

Related U.S. Application Data

(63) Continuation of application No. 14/657,515, filed on Mar. 13, 2015, now Pat. No. 9,433,817, which is a (Continued)

(51) Int. Cl.
*A63B 24/00* (2006.01)
*A63B 5/16* (2006.01)
(Continued)

(52) U.S. Cl.
CPC ..... *A63B 5/16* (2013.01); *A63B 6/02* (2013.01); *A63B 21/00069* (2013.01); *A63B 21/045* (2013.01); *A63B 21/0442* (2013.01); *A63B 21/0552* (2013.01); *A63B 21/153* (2013.01); *A63B 21/4005* (2015.10); *A63B 21/4007* (2015.10); *A63B 21/4009* (2015.10); *A63B 21/4013* (2015.10); *A63B 21/4015* (2015.10);
(Continued)

(58) Field of Classification Search
CPC ..... A63B 21/4007; A63B 21/008; A63B 22/0235; A63B 21/00069; A63B 21/0442; A63B 21/0552; A63B 21/153; A63B 5/16; A63B 6/02; A63B 69/0028; A63B 69/0053; A63B 71/0622; A63B 2220/16; A63B 2220/17; A63B 2220/20; A63B 2220/30; A63B 2220/40; A63B 2220/51; A63B 2220/78
See application file for complete search history.

(56) References Cited

U.S. PATENT DOCUMENTS 4,146,222 A * 3/1979 Hribar ..... A63B 21/008 482/112
4,391,443 A 7/1983 Beecroft
(Continued)

FOREIGN PATENT DOCUMENTS

| | | |
|---|---|---|
| DE | 20 2009 014 468 | 2/2010 |
| WO | WO 2006/062319 | 6/2006 |
| WO | WO 2008/153979 | 12/2008 |

OTHER PUBLICATIONS

U.S. Appl. No. 14/657,515, filed Mar. 13, 2015.

*Primary Examiner* — Glenn Richman
(74) *Attorney, Agent, or Firm* — Barnes & Thornburg LLP

(57) ABSTRACT

An exercise apparatus including a frame, and a cushion adjacent to the frame having a surface. The exercise apparatus further includes a harness wearable by the user and a resistance member extending between the harness and the frame and where the tension within the resistance member is variable.

18 Claims, 18 Drawing Sheets

Related U.S. Application Data continuation of application No. 13/072,452, filed on Mar. 25, 2011, now Pat. No. 8,979,709.

(60) Provisional application No. 61/318,085, filed on Mar. 26, 2010.

(51) Int. Cl.

| | |
|---|---|
| ***A63B 6/02*** | (2006.01) |
| ***A63B 21/00*** | (2006.01) |
| ***A63B 21/04*** | (2006.01) |
| ***A63B 21/055*** | (2006.01) |
| ***A63B 23/02*** | (2006.01) |
| ***A63B 23/04*** | (2006.01) |
| ***A63B 26/00*** | (2006.01) |
| ***A63B 69/00*** | (2006.01) |
| ***A63B 21/045*** | (2006.01) |
| *A63B 22/02* | (2006.01) |
| *A63B 71/06* | (2006.01) |
| *A63B 71/00* | (2006.01) |

(52) U.S. Cl.

CPC ..... *A63B 21/4021* (2015.10); *A63B 21/4035* (2015.10); *A63B 21/4037* (2015.10); *A63B 23/0211* (2013.01); *A63B 23/047* (2013.01); *A63B 26/00* (2013.01); *A63B 69/0028* (2013.01); *A63B 69/0035* (2013.01); *A63B 22/0285* (2013.01); *A63B 69/0053* (2013.01); *A63B 71/0622* (2013.01); *A63B 2071/0063* (2013.01); *A63B 2071/0072* (2013.01); *A63B 2208/0204* (2013.01); *A63B 2209/00* (2013.01); *A63B 2210/50* (2013.01); *A63B 2220/16* (2013.01); *A63B 2220/17* (2013.01); *A63B 2220/20* (2013.01); *A63B 2220/30* (2013.01); *A63B 2220/40* (2013.01); *A63B 2220/51* (2013.01); *A63B 2220/78* (2013.01); *A63B 2230/06* (2013.01); *A63B 2230/75* (2013.01); *Y10S 482/901* (2013.01)

(56) References Cited

U.S. PATENT DOCUMENTS

| | | | | |
|---|---|---|---|---|
| 4,674,160 | A | 6/1987 | Gibson | |
| 5,656,000 | A | 8/1997 | Russell | |
| 5,853,352 | A | 12/1998 | Login | |
| 6,042,516 | A | 3/2000 | Norton | |
| 6,162,151 | A | 12/2000 | Tani et al. | |
| 7,104,926 | B2 | 9/2006 | Carlson | |
| 7,270,628 | B2 | 9/2007 | Campaaro et al. | |
| 7,608,015 | B2 * | 10/2009 | Radow ..... | A63B 22/0235 482/1 |
| 8,257,232 | B2 | 9/2012 | Albert | |
| 2005/0032613 | A1 * | 2/2005 | Wehrell ..... | A63B 21/4007 482/133 |
| 2006/0199711 | A1 | 9/2006 | Miers | |
| 2006/0201580 | A1 | 9/2006 | Kang | |
| 2007/0232461 | A1 | 10/2007 | Jenkins | |
| 2014/0323270 | A1 | 10/2014 | Lawrence | |

* cited by examiner

EXERCISE APPARATUS

CROSS-REFERENCE TO RELATED APPLICATION

This application is a Continuation of copending U.S. patent application Ser. No. 14/657,515, filed Mar. 13, 2015, which is a Continuation of U.S. patent application Ser. No. 13/072,452, filed Mar. 25, 2011 (now U.S. Pat. No. 8,979,709), which claims the benefit of priority from U.S. Provisional Patent Application No. 61/318,085 filed Mar. 26, 2010. The disclosures set forth in the referenced applications are incorporated herein by reference in their entireties.

FIELD OF THE INVENTION

The present invention relates to exercise equipment, and more specifically to cardiovascular exercise equipment.

BACKGROUND

Cardiovascular exercise equipment works the heart, lungs, and various muscle groups to improve a user's endurance and strength. The devices typically require the user to run, jog, walk, bike, climb, and the like for a prolonged period of time to build up the lungs and heart, as well as promote muscle health. Typical cardiovascular equipment includes treadmills, elliptical machines, exercise bikes, steppers, and the like.

SUMMARY

In some exemplary embodiments, an exercise apparatus is provided. The exercise apparatus includes a cushion having a surface on which a user may be supported, a frame adjacent to the cushion, and a resistance member attached to the frame and engageable by the user, where the tension within the resistance member is variable for a given position of the user.

In another exemplary embodiment, an exercise apparatus is provided. The exercise apparatus includes a cushion having a surface, a frame adjacent to the cushion, a tension adjuster coupled to the frame, a harness wearable by a user, and a resistance member extending between the harness and the tension adjuster. Where the tension adjuster permits variation of the tension within the resistance member.

In yet another exemplary embodiment, an exercise apparatus is provided. The exercise apparatus includes a frame, a fluid-containing cushion adjacent to the frame having a surface, a valve for changing the amount of fluid within the cushion so that the surface can be adjusted between a first firmness and a second firmness different from the first firmness, a harness wearable by a user, and a resistance member extending between the harness and the frame.

In yet another exemplary embodiment, an exercise apparatus is provided. The exercise apparatus includes a frame, a cushion adjacent the frame and having a surface, one or more footfall sensors adjacent the surface to detect when a user's foot impacts the surface, a harness wearable by the user, and a resistance member extending between the harness and the frame.

In yet another exemplary embodiment, an exercise apparatus is provided. The exercise apparatus includes a cushion having a surface, a frame adjacent to the cushion, an adjuster coupled to the frame, a harness wearable by a user, and a cord extending between the harness and the adjuster, where the adjuster permits variation of the position of the user on the surface of the cushion.

In yet another exemplary embodiment, an exercise apparatus is provided. The exercise apparatus includes a rigid structure, a cushion positionable on a support surface adjacent the rigid structure, the cushion having a surface configured to support a user, and an extendable resistance member coupled to the rigid structure and engageable by the user.

Figure 1:
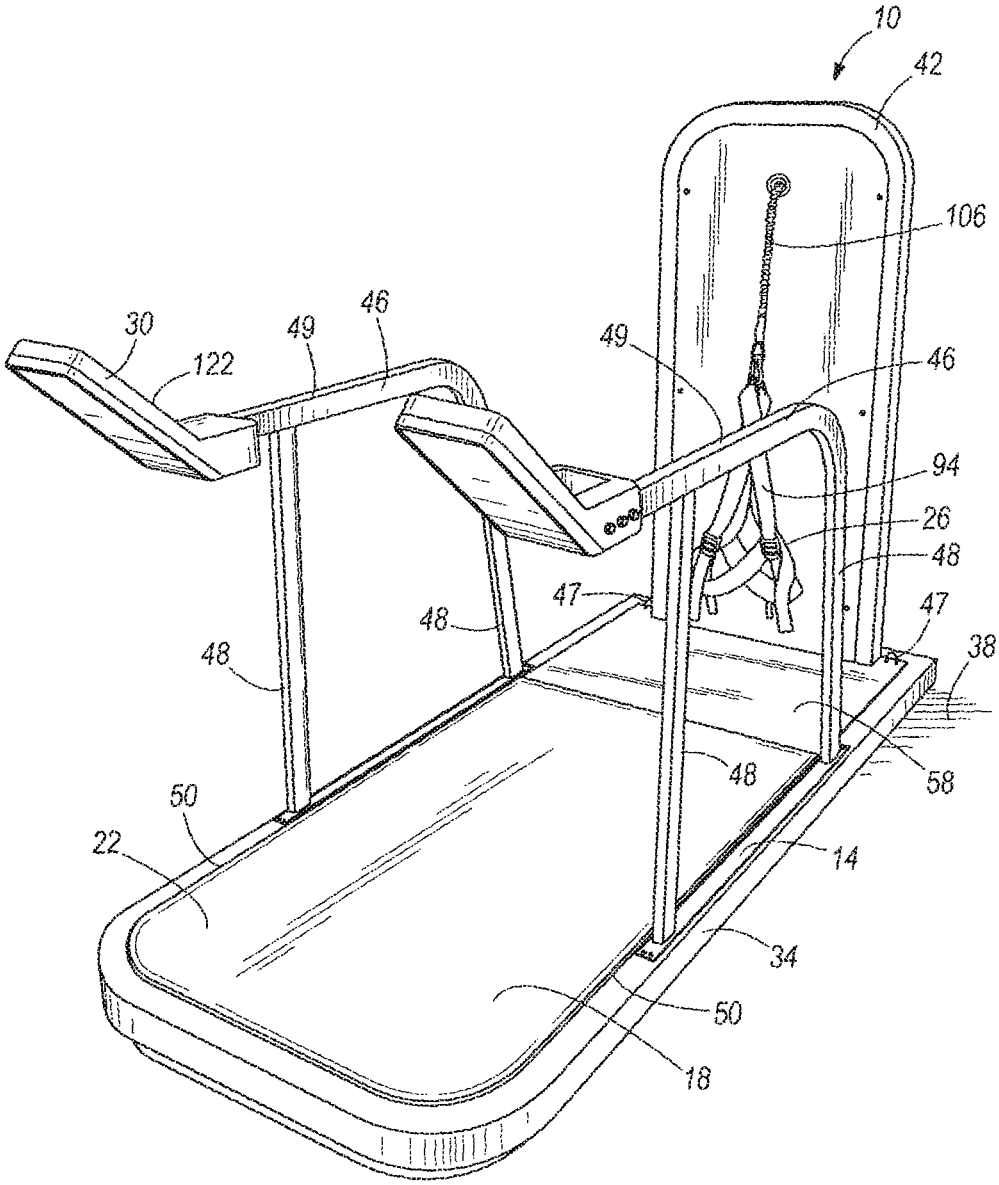
FIG. 1 is a perspective view of the exercise apparatus.

It is to be understood that the invention is not limited in its application to the details of construction and the arrangements of the components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION

FIGS. 1-4*d* illustrate a cardiovascular exercise device 10 designed to simulate the experience of running or walking on a soft surface such as sand, grass, water, and the like. These types of surfaces both absorb shock—making running or walking easier on the feet, knees, back, and joints—as well as provide some resistance to running or walking as the user's feet sink into the soft material at each footfall. In some instances, these types of surfaces absorb shock and provide more resiliency than a hard surface, making running or walking easier on the feet, knees, back and joints, as well as easier to exercise because of the returned energy from the surface. In the present invention, the soft surface is created through the use of a fluid (gas, gel, or liquid) filled bladder, a sand filled bladder, a foam pad, or other resilient surfaces on which the user runs during a workout session, with the user typically held in place by a cord connected to a belt or harness worn by the user. In addition to the soft running surface, the present invention also provides resistance in the form of elastic tension through the use of elastic cords fixed at one end to the device and coupled to one or more points on the user's body. The device can also be used to facilitate stretching, jumping and other forms of muscle activation.

Figure 12:
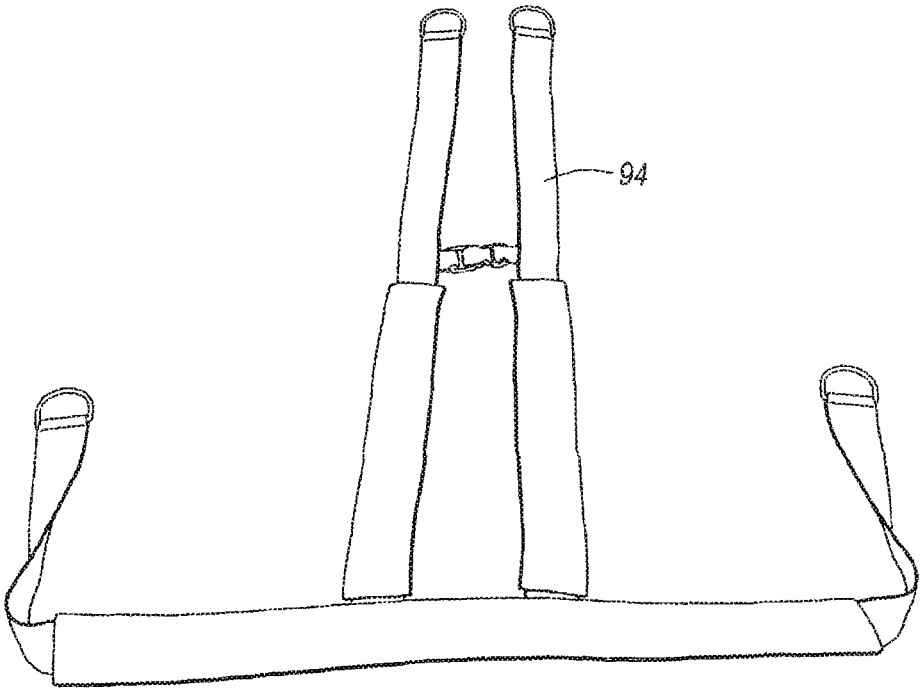
FIG. 12 illustrates one embodiment of a harness.

As illustrated in FIGS. 1-4*d*, the cardiovascular exercise device 10 includes a frame 14, a cushion 18 producing a running surface 22, and a harness assembly 26. In some constructions, the exercise device 10 may also include a biometric feed-back device or control unit 30 to supply the user with information regarding, but not limited to, the number of footfalls, the user's speed, distance traveled, calories burned, heart rate, cushion air pressure, surface angle and the like (see FIG. 12).

Figure 2:
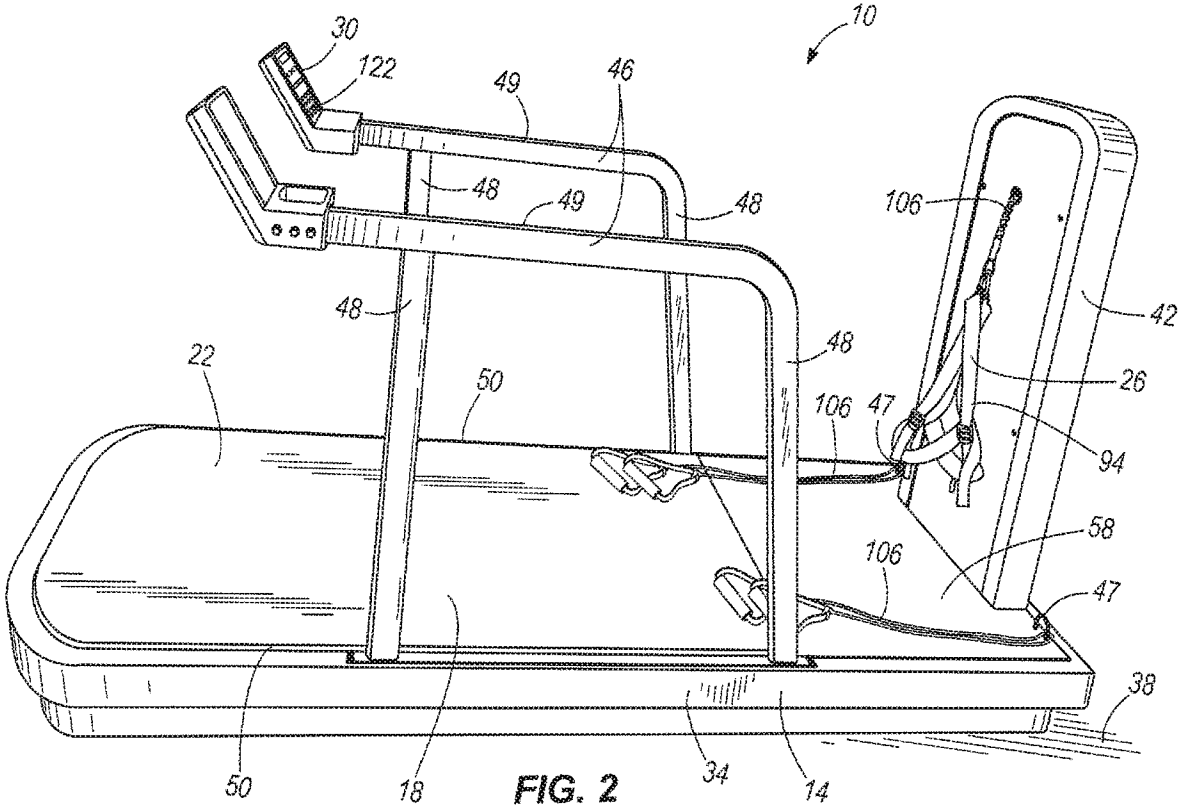
FIG. 2 is a side view of the exercise apparatus of FIG. 1.
Figure 3:
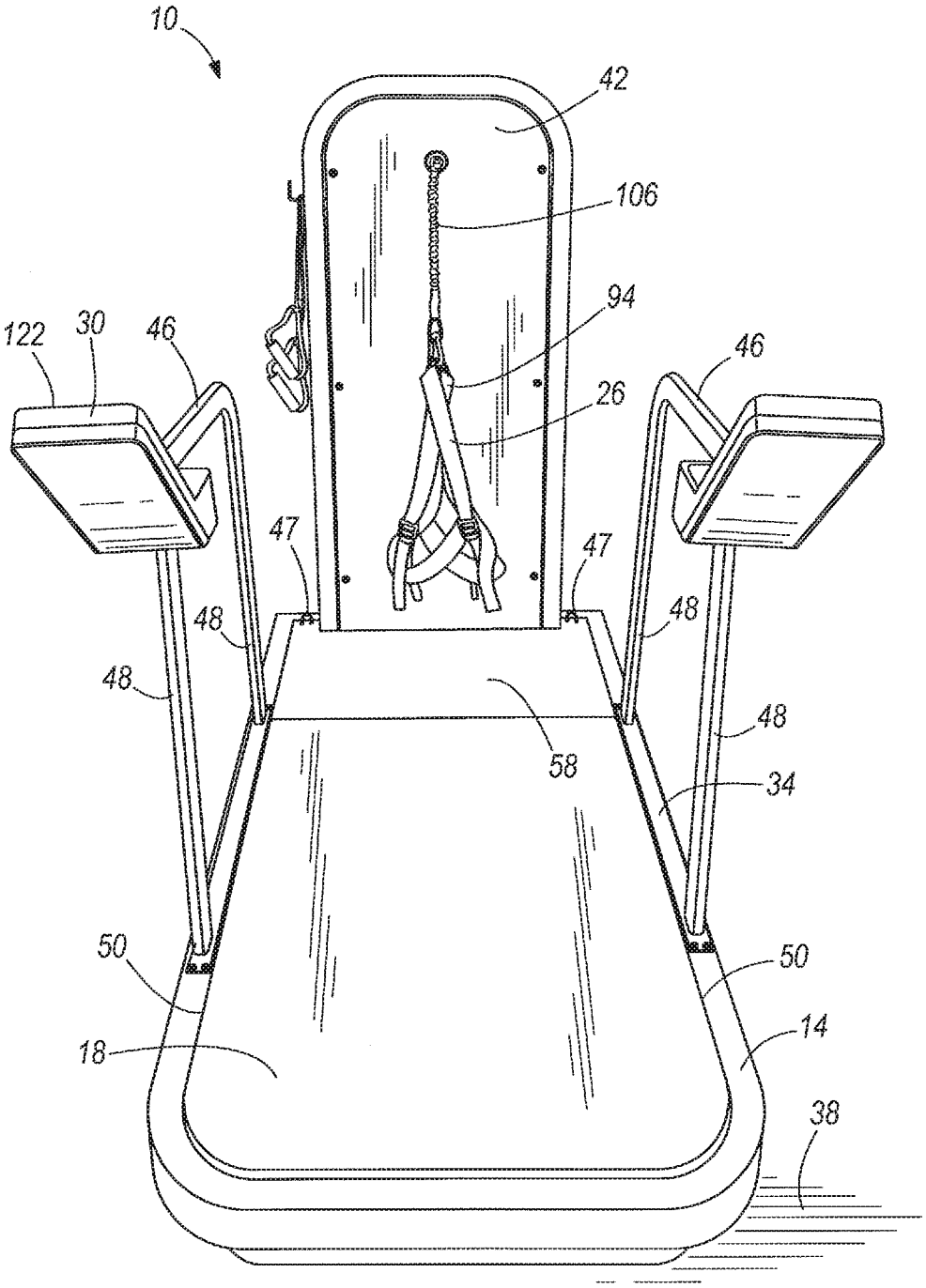
FIG. 3 is a front view of the exercise apparatus of FIG. 1.
Figure 4A:
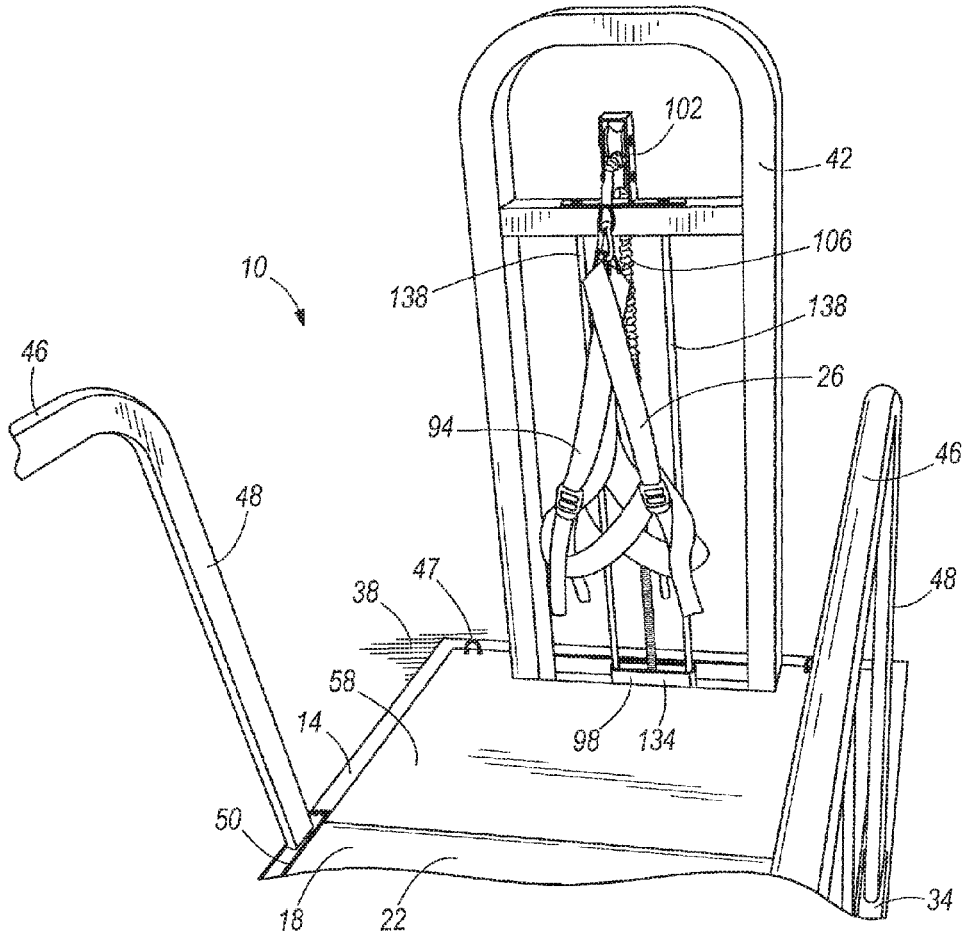
FIG. 4*a* is a detailed view of the upright of the exercise apparatus of FIG. 1 with the cover removed.
Figure 4B:
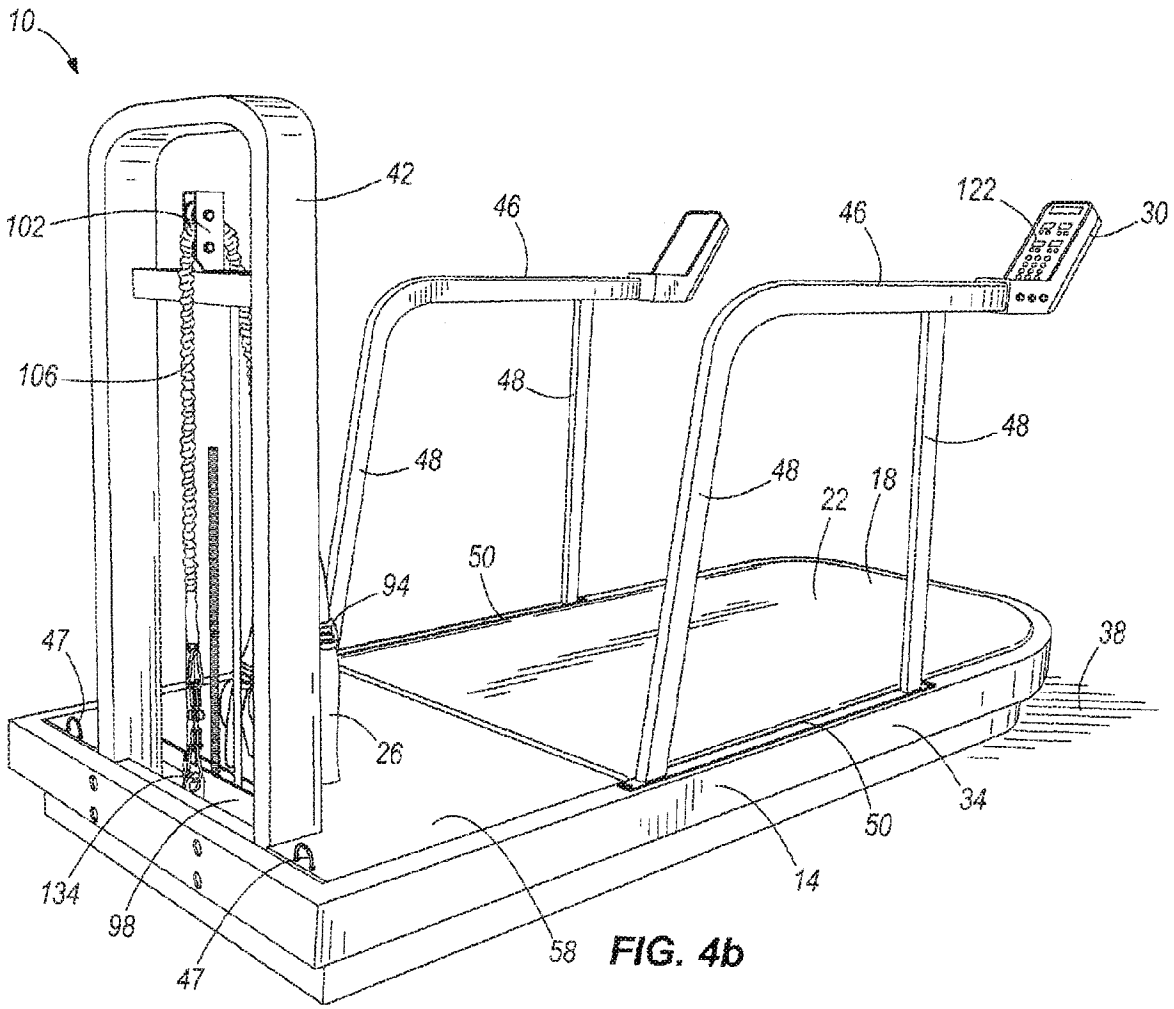
FIG. 4*b* is a rear detailed view of the upright of the exercise apparatus of FIG. 1 with the cover removed.
Figure 4C:
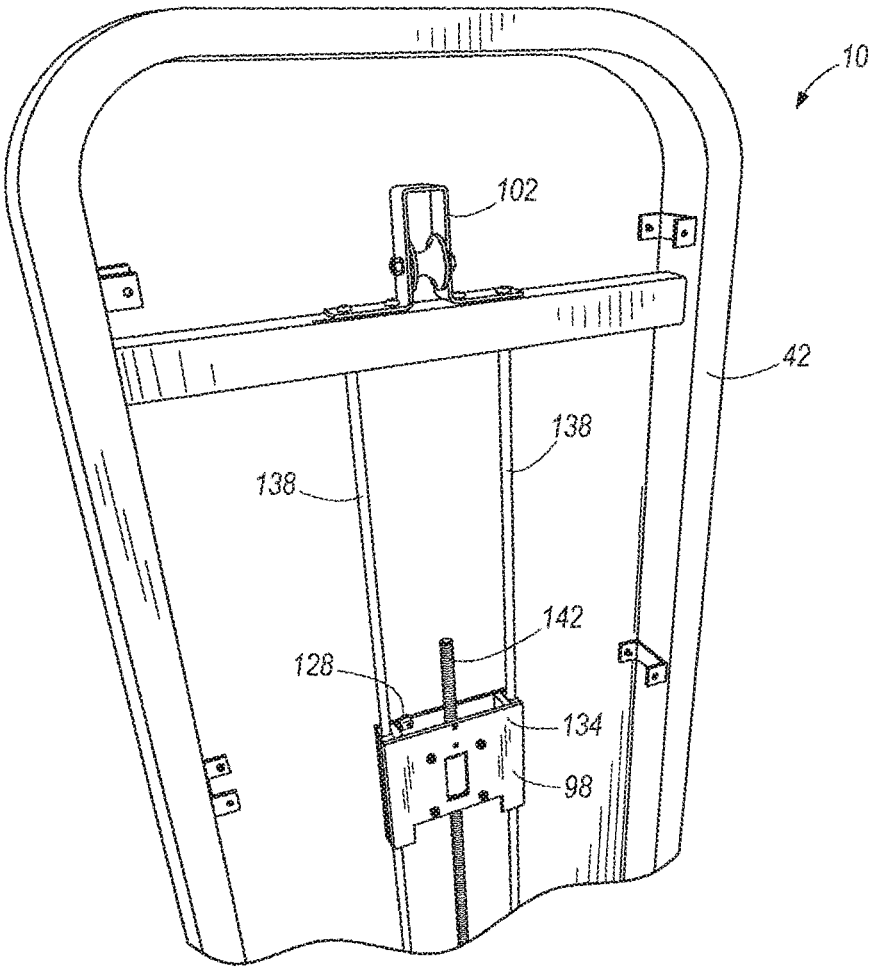
FIG. 4*c* is a detailed view of the pulley of FIG. 4*a*.
Figure 4D:
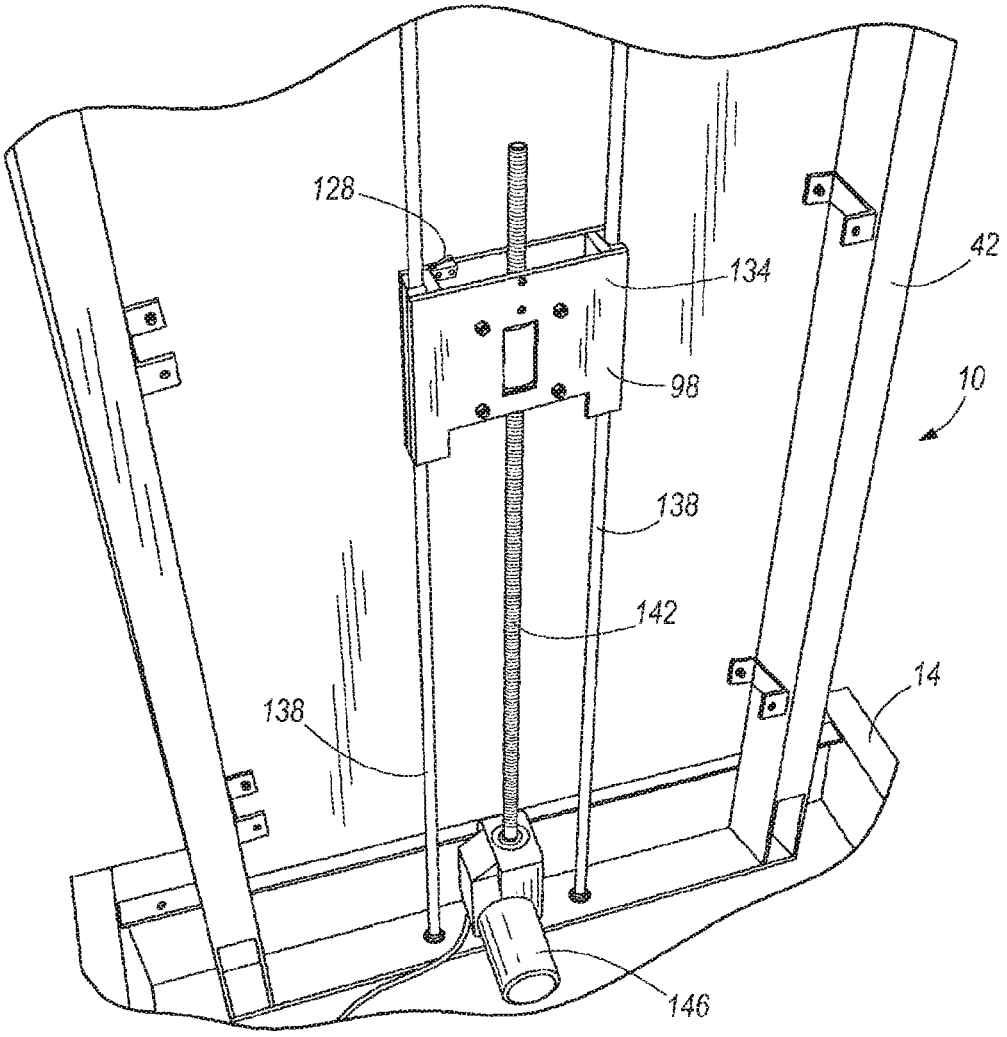
FIG. 4*d* is a detailed view of the adjuster of FIG. 4*a*.

As illustrated in FIGS. 1 and 2, the frame 14 includes a base 34 resting on a support surface 38 (e.g., the ground or floor) to provide a stable foundation for the cushion 18, and the upright portion 42 (described below). In some constructions (not shown) either the base 34 or the upright 42 may fold into or on top of one another for storage or transport. The base 34 generally at least partially encompasses the cushion 18. In some constructions, the base 34 may also include an elevated floor (not shown) onto which the cushion 18 may be placed and distanced from sharp objects, uneven ground, and the like. In alternate constructions, the base 34 may also include a tilting mechanism (not shown), supporting the cushion 18 and able to place the running surface 22 at different inclines or angles with respect to the support surface 38. In some constructions, the base 34 may also include wheels (not shown) to allow the entire frame 14 to be easily moved across the support surface 38. In still another construction, the cushion 18 may be placed directly on the support surface 38 adjacent a wall, beam, partition, or other form of rigid structure with the cord 106 extending between the user and rigid structure.

The frame 14 may also include one or more arm rails 46 positioned above and preferably at least partially parallel to the running surface 22 to offer support or stabilize the user while stepping onto or off of the running surface 22, as well as during the workout itself. Each arm rail 46 may also be used as a support bar during particular non-running exercises such as balance and stretching exercises. Each arm rail 46 includes a rod or pole 49 extending generally horizontally above the running surface 22 and supported by a pair of vertical support bars 48. The rod is sized so it can be easily grasped by a user. Furthermore, each arm rail 46 may be coated with a high friction material, such as rubber or thermoplastic elastomer, to minimize slipping and improve grip. In the illustrated construction, the frame 14 includes a pair of arm rails 46 extending parallel to the sides 50 of the running surface 22. However, in alternate constructions, more or fewer arm rails 46 may be used as necessary. In yet another construction, multiple, vertically spaced arm rails (not shown) may be used to accommodate users of differing heights. In yet another construction (not shown), the height of each arm rail 46 may be adjustable.

The frame 14 may also include a removable front support (not shown) coupled to and extending between the arm rails 46. The front support may be pivotably coupled to one of the arm rails 46 and may be moved between an upright position (e.g., substantially vertical), and a lowered position, where it extends above and across the running surface 22, typically in front of the user, to provide additional support or grasping areas while the user is exercising on the running surface 22. In the event the additional support is not necessary, the front support may be removed or pivoted to the upright position, leaving the front of the exercise apparatus 10 unobstructed. The front support may also be permanently coupled to the frame 14. In still other constructions, the front support may be used to house the electronic control device for the machine or an entertainment device for the machine or some combination of both.

The frame 14 may also include a platform or staging area 58 positioned substantially adjacent to the running surface 22 and fixed to the base 34. The platform 58 provides a substantially stable support surface proximate the running surface 22 to aid stepping onto and off of the cushion 18. Typically, the platform 58 is covered with a high friction material, such as rubber, or diamond plate to maximize traction and reduce slipping. In the illustrated construction, the top surface of the platform 58 is generally co-planar with the running surface 22.

The frame 14 also includes an upright 42 extending substantially vertically from the base 34 and adjacent to the platform 58 to provide a plurality of mounting locations for the harness assembly 26. The upright 42 extends vertically from the base 34 to at least the height of a typical user's waist, and preferably extends all the way to a typical user's shoulders. In alternate constructions, the upright 42 may also include a plurality of support rods or braces (not shown) extending between the upright 42 and the base 34 to provide additional rigidity to the overall structure. In yet other constructions, the upright 42 may also include a plurality of brackets, hooks, mounting locations, and the like, to hang various accessories including but not limited to additional elastic cords (not shown). In yet another alternate construction, the upright may be absent with the harness assembly tethered directly to a point on the frame.

As described above, the cushion 18 provides a running surface 22 and uses one of a fluid filled bladder, a foam pad, a sand filled bladder, or a combination thereof to dampen or absorb the footfalls of the user and to provide the general feeling of running on sand, water, grass, or other soft surfaces. Unlike treadmills and elliptical machines, the cushion 18 does not provide a selectable, pre-set running speed or foot path that the user must follow during the workout; rather, the user runs, jogs, jumps, lunges or walks in place on the running surface 22, and may pace or direct themselves as they feel fit.

Figure 5:
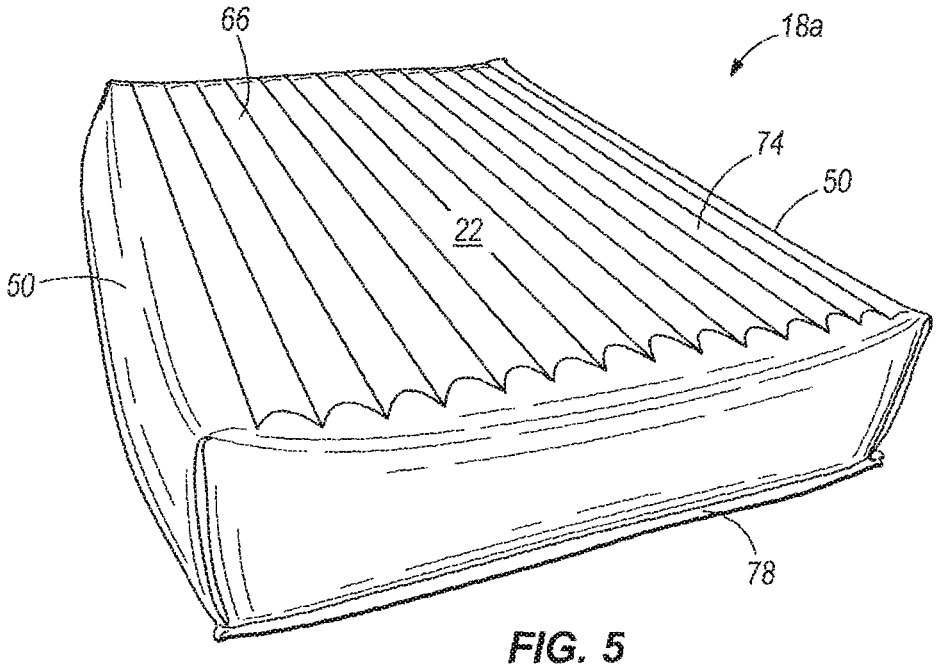
FIG. 5 is a perspective view of one embodiment of the cushion.

In a first embodiment 18*a* of the cushion, the cushion includes a substantially rectangular, sealed bladder 66 defining a volume therein filled with a fluid such as air, water, gel, gas, oil, sand, and the like (see FIG. 5). The bladder 66 is formed from at least one of coated polyurethane, polyurethane coated nylon, vinyl and the like, and may be formed from 200 or 400 denier nylon, coated on both sides with polyurethane. In one construction, the cushion 18*a* also includes webbing, generally having a substantially I-shaped cross-section (not shown), extending between the top and bottom panels 74, 78 to help maintain the overall rectangular shape of the bladder 66. In another construction, the cushion may be made of PVC with internal distance fabric (35,000 fibers per m2). In still other constructions, no webbing may be present.

In the first embodiment, the cushion 18*a* is a sealed system, and no constantly running blower unit is required. A blower unit (not shown) may be included to intermittently fill or increase the pressure within the bladder 66 as needed to adjust the firmness of the running surface 22. In the current invention, the bladder 66 is rated to withstand the loads generated by a 500 pound individual.

Figure 8C:
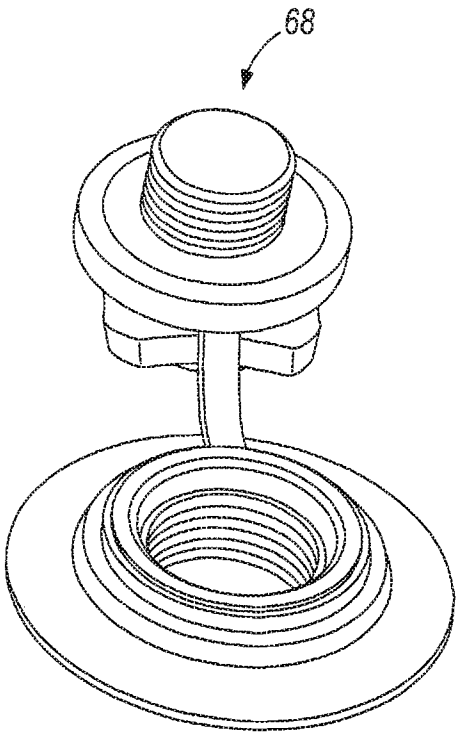
FIGS. 8*a*-8*c* illustrate various stages of the bladder valve.
Figure 8B:
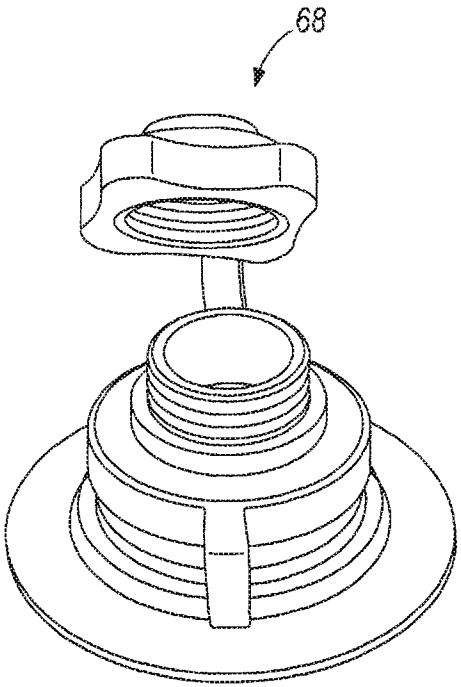
Figure 8A:
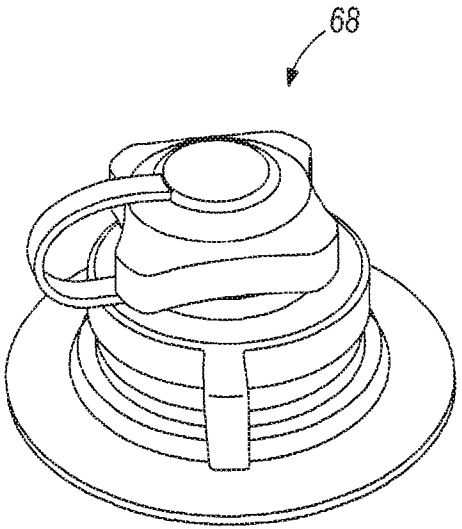

Illustrated in FIGS. 8*a*-8*c*, the bladder 66 also includes a valve 68 to control the flow of fluids into and out of the bladder 66. In the illustrated construction, the valve 68 includes a sealed configuration (see FIG. 8*a*), where no fluid can move into or out of the bladder 66: a fill configuration (see FIG. 8*b*), where fluid can only be introduced into the bladder 66; and a drain configuration (see FIG. 8*c*), where fluid is free to flow into and out of the bladder 66.

Figure 6A:
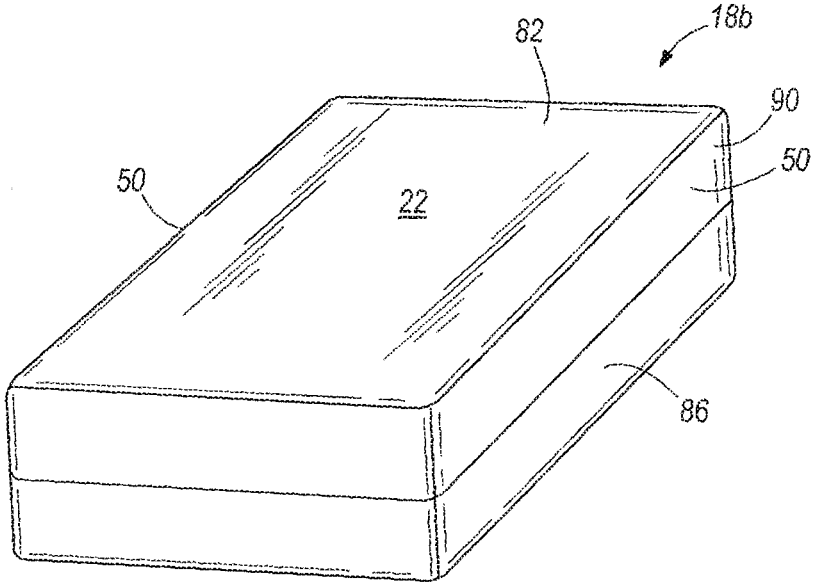
FIG. 6*a* is a perspective view of another embodiment of the cushion.
Figure 6B:
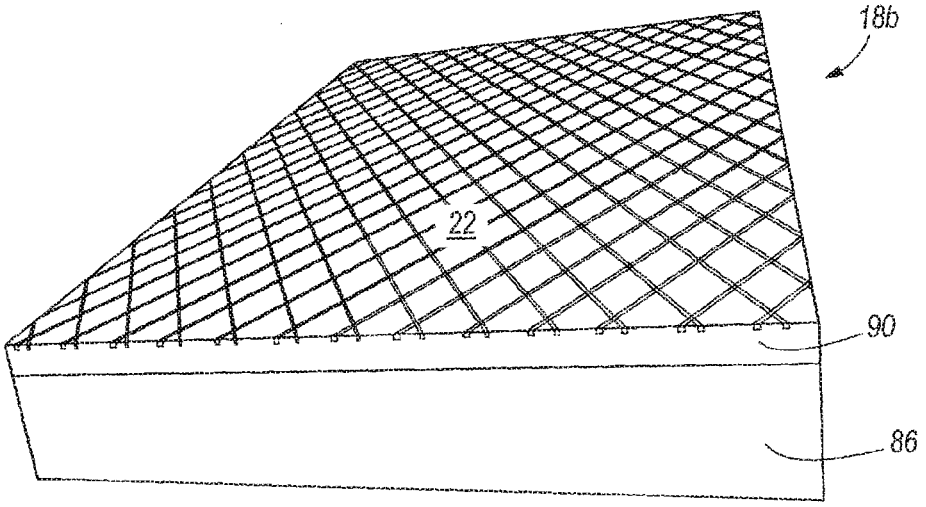
FIG. 6*b* is a perspective view of another embodiment of the cushion.

In a second embodiment 18*b* of the cushion, the cushion includes one or more layers of foam (see FIG. 6). More specifically, the cushion 18*b* may comprise any combination of, but is not limited to, visco-elastic foam, reticulated foam, un-reticulated foam, and the like. In the illustrated construction, the cushion 18*b* includes a first bottom layer 86 formed from a first foam material, and a second top layer 90, positioned atop the bottom layer 86, and formed from a second foam material softer (i.e., providing less resistance to indentation) than the first foam material. In some constructions, the second top layer 90 may also define a plurality of channels (not shown) extending therethrough. The cushion 18*b* is preferably 6 inches thick. In a preferred construction, the foam includes the Mason Medical Products Pressure Reducing Foam Multi-Ply Series 6500. In another construction, the cushion 18*b* may include a single dense layer of foam 6 inches thick. Illustrated in FIG. 6*b*, the running surface 22 may also include a plurality of grooves or contours to change the feel of the surface 22.

In a third embodiment of the cushion (not shown), the cushion includes a combination of foam layers and fluid filled bladders. Different combinations of foam and fluid (e.g., bladder) layers may be assembled or stacked upon one another to produce a variety of resistance properties to the running surface 22.

In a fourth embodiment of the cushion (not shown), the cushion may include a piece of resilient sheet material, pulled taught over the base 34 to produce the running surface 22. The sheet material may be directly coupled to the base 34, or be held taught by a plurality of biasing members (e.g., springs) along its perimeter, spaced from the base like a trampoline, to produce the desired running surface 22 properties. In some constructions, the sheet material may include any one of fabric, nylon, rubber, PVC, and the like.

In some specific constructions of the exercise device 10, the one or more cushions 18 present within the frame 14 may be removed and replaced with one or more alternative cushions. This allows the user to tailor the resistance properties of the running surface 22 for a particular workout. For example, the user may replace a fluid or sand filled bladder 66 with a foam cushion 18*b*, while in other cases, the user may replace a first foam cushion 18*b* having a first firmness with another foam cushion of a different firmness. In still other constructions, the cushion 18 may be encompassed in a protective cover to protect the cushion 18 from wear, damage, and puncture (when applicable).

As illustrated in FIGS. 1-4*d*, the harness assembly 26 includes one or more harnesses or belts 94 couplable to one or more locations on the user's body (e.g., torso, shoulders, waist, wrist, ankle, and the like) and one or more tensionable resistance members or cords 106. A tension adjuster or adjuster 98 is coupled to and movable along the frame 14 and a pulley 102 is pivotably coupled to the frame 14. The one or more cords 106 each extend between the adjuster 98 and a respective harness 94. The harness assembly 26 provides resistance to the user during the workout in the form of tension imposed by cord 106 on the connected portion of the user's body. During a workout, the user essentially runs, walks, jogs, or performs other athletic moves against the tension from the cords 106 to essentially remain in place. The harness assembly 26 may, in some constructions, be modified to target different muscle groups by changing the locations, or combination of locations, to which the cords 106 are coupled. One construction of a shoulder style harness is illustrated in FIG. 13.

Tension in the cord 106 is adjusted with a tension adjuster or adjuster 98, which is generally positioned on and movable along the height of the upright 42 portion of the frame 14. One or more cords 106 are coupled to and extend from the adjuster 98, such that moving the adjuster 98 along the height of the upright 42 alters the tension within the cords 106, assuming the user remains in a single location during the workout. More specifically, when the adjuster 98 is moved towards the top of the upright or towards the pulley 102, the length of the cord 106 becomes shorter, lowering the tension within the cord. In contrast, when the adjuster 98 is moved towards the bottom of the upright 42 or away from the pulley 102, the cord 106 becomes longer or is stretched, increasing the tension within the cord. In some constructions, multiple cords 106 may be coupled to a single adjuster 98 such that the cords increase and decrease in tension together. However, in other constructions, multiple adjusters 98 may be present, such that each cord 106 can be adjusted individually. In the illustrated construction, the adjuster 98 is moveable automatically during the workout (e.g., by a linear actuator), either by the control unit 30 (described below), by manual inputs from the user, or a combination thereof.

It should be noted that the user position and tension in the cord are inter-related. As such, in the instances where a non-elastic cord is used or the user wishes to maintain a constant tension in the cord 106 (e.g., maintains a constant cord length), the adjuster 98 may be used to alter the user's position on the running surface 22 (i.e. the user's maximum distance from the upright when the cord is fully extended). In such constructions, as the adjuster 98 moves towards the top of the upright or pulley 102, the length of cord 106 extending from the upright 42 grows longer and the user is able to move away from the upright 42 or towards the front of the exercise apparatus 10. In contrast, when the adjuster 98 moves towards the bottom of the upright, the length of the cord 106 extending from the upright 42 decreases and the user moves towards the upright 42 or the back of the exercise apparatus 10.

Furthermore, a combination of both tension and user's position adjustments may be used during the operation of the exercise device. For example, the user may adjust the tension within the cord 106 until the tension exceeds a pre-determined limit and the cord 106 goes taut (e.g., the sheath 118, described below, is fully extended). At this time, the length of the cord can no longer be extended and any additional movement of the adjuster 98 will cause the user to vary his/her position on running surface 22 in order to keep the cord taut.

Tension or position adjustment is illustrated in FIGS. 4*a*-4*d*. The adjuster 98 of the illustrated construction includes a pair of parallel guide rods 138, a plate 134 moveable along the pair guide rods 138, and a jackscrew 142 threadably coupled to the plate 134 and rotated by a motor 146. To adjust the tension within the cords 106, the electric motor 146 rotates the jackscrew 142 causing the plate 134 to move along the length of the guide rods 138 with respect the upright 42. In other constructions, alternate embodiments of the adjuster 98 may be used, such as, but not limited to a rotatable drum on which the cord can be wound, pulleys with adjustable center distances, a pin attached to the end of the cord 106 that can be anchored at various locations on the frame or upright, and the like.

Figure 10:
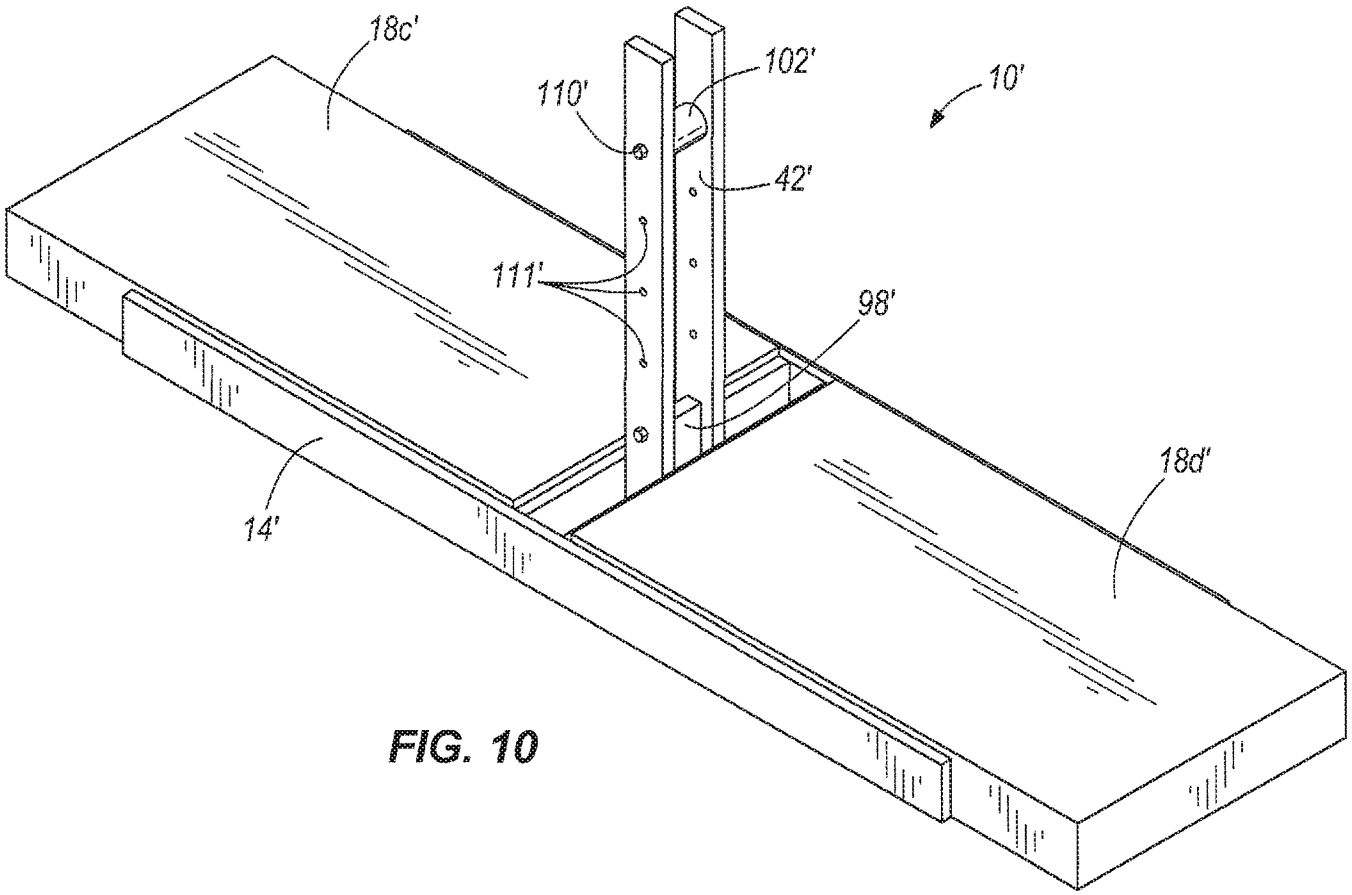
FIG. 10 is a perspective view of another embodiment of the exercise apparatus.

The pulley 120 may be pivotably couplable to and vertically adjustable (as shown in FIG. 10) along the height of the upright 42. The pulley 102 pivots with respect to the upright 42 to reduce the amount of wear or friction experienced by the cords 106. The pulley 102 is positionable along the height of the upright 42 to adjust the angle at which the cords 106 will extend from the user during a workout. More specifically, when the pulley 102 is positioned proximate the bottom of the upright 42, the cords 106 generally pull downwardly and rearwardly. When the pulley 102 is positioned towards the top of the upright 42, the cords 106 generally pull upwardly and rearwardly. And when the pulley 102 is positioned substantially equal in height with the user's torso, the cords 106 generally pull straight back. The position of the pulley 102 is typically adjusted dependent upon the weight of the user, the force of the user against the harness and bungee, the user's height, and the targeted muscle groups. In some constructions, multiple pulleys 102 positioned at various heights along the upright 42 may be used so each cord 106 may extend at different angles from the user.

Illustrated in FIG. 10, the pulley 102 is adjusted vertically along the height of the upright 42 through use of a pin 110. The pin 110 extends between a pair of apertures 111, defined by and located at various heights along the upright 42, and radially restrains the pulley 102 while allowing it to rotate. To adjust the height of the pulley 102, all tension is removed from the system (e.g., the cords 106 are removed) and the pin 110 is removed from the corresponding apertures 111. The pulley 102 is then adjusted to and aligned with a new, second pair of apertures 111, closest to the desired vertical position, and the pin 110 is re-inserted.

Figure 7:
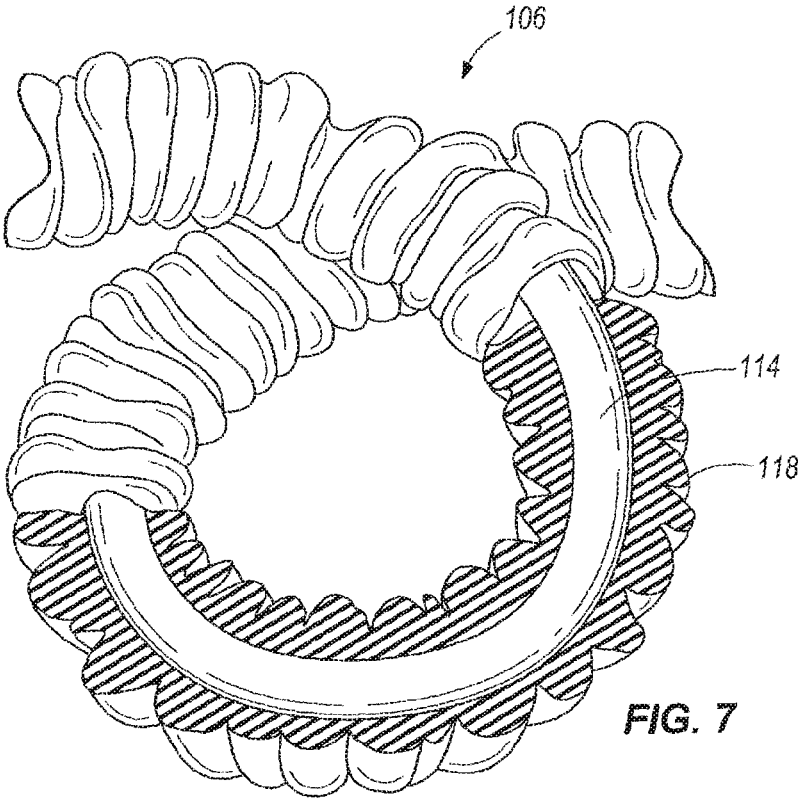
FIG. 7 is a partial section view of the cord.

Each cord 106 generally extends between an adjuster 98 and a harness 94, running over the pulley 102 therebetween. In the illustrated construction, each cord 106 is a two piece design, having an inner bungee or rubber core 114, and a fabric sheath 118 substantially encompassing the rubber core 114 (see FIG. 7). The rubber core 114 is elastic, and produces an inward or tensional force when stretched or elongated from a natural rest state. The fabric sheath 118 acts as a safety feature, such that if the rubber core 114 were to break or rupture, the fabric sheath 118 stops the user from falling forward, by maintaining the connection between the harness 94 and adjuster 98. The sheath 118 also prevents the rubber core from recoiling and potentially striking the user or a nearby observer. In the illustrated construction, the present invention utilizes a Slastix™ bungee cord made by Stroops™. In alternate constructions, the cords 106 may be elastic (e.g., bungee elastic), or inelastic (e.g., a cable or a rope). In yet other constructions, one or more of the cords 106 may be coupled directly to the upright 42 at the same or various locations. In still other constructions, the exercise apparatus 10 may also include additional cords 106 extending from the arm rails 46 or mounting points 47 of the frame 14.

The cord 106 may also include one or more handles (not shown) which the user can grasp during the workout. Furthermore, in the particular embodiment where wrist or ankle harnesses are used in combination with a torso harness, different strength cords 106 may be used in combination, dependent upon the amount of resistance the user prefers on each area of the body. In addition, multiple cords 106 may be used between a single harness 94 and the adjuster 98 when a single cord 106 does not provide sufficient resistance for the user's purpose.

Figure 9:
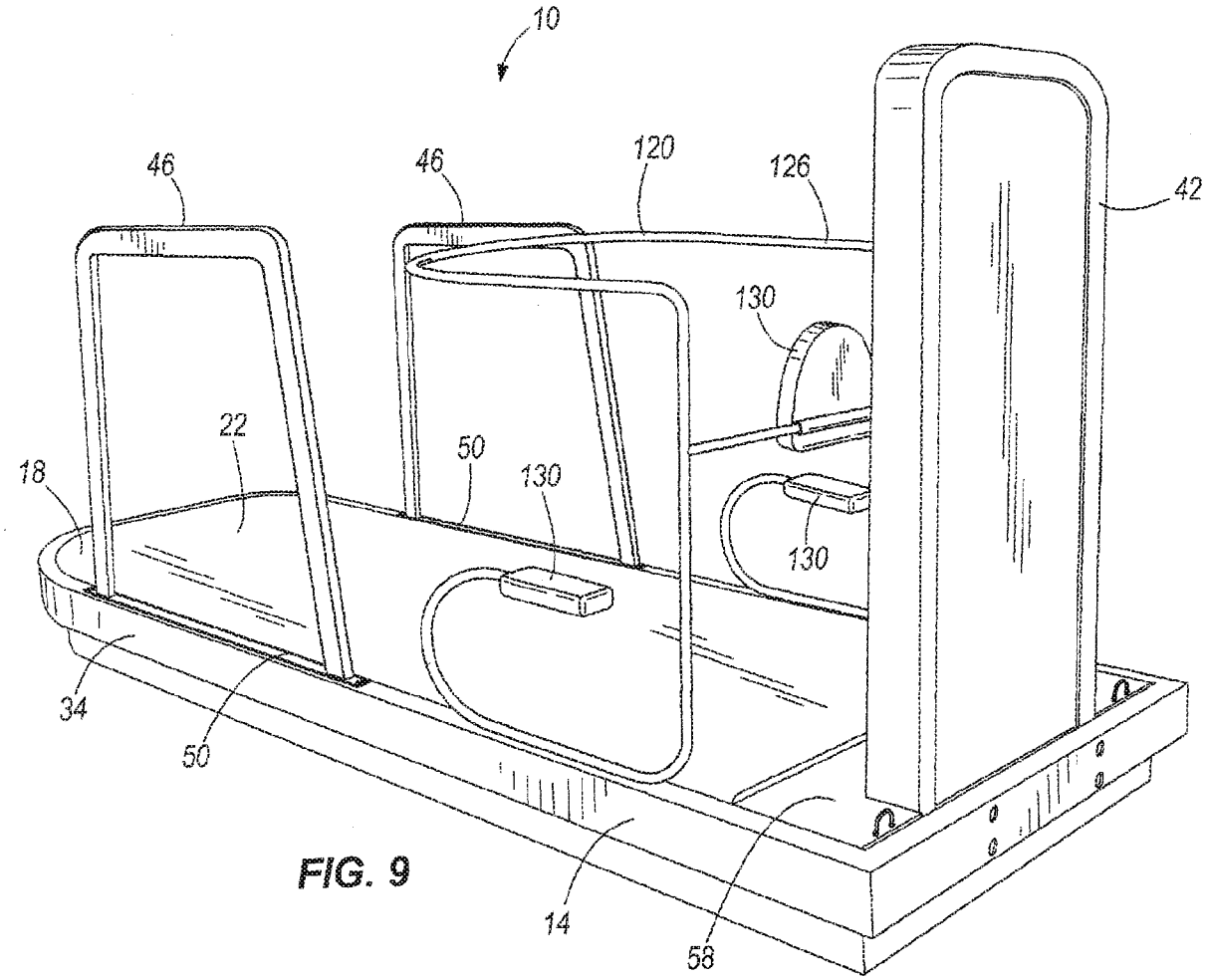
FIG. 9 is a perspective view of the exercise apparatus of FIG. 1 with an abdominal attachment.

FIG. 9 illustrates the exercise apparatus 10 with an abdominal attachment 120. The abdominal attachment 120 includes a tubular abdominal frame 126 removably couplable to the frame 14, and a plurality of pads 130 positioned on the abdominal frame 126 at various locations to support or assist the user during an abdominal crunch. The abdominal attachment 120 allows the user to utilize the running surface 22 as a mat, or padded surface, on which he or she may do abdominal or other exercises.

FIG. 10 illustrates an alternate construction 10' of the exercise apparatus. In the alternate construction, the apparatus 10' includes a first cushion **18*c*' and a second cushion 18*d*', each extending generally oppositely from the upright 42'. In the alternate construction, the cushions 18*c*', 18*d*'** may include a fluid filled bladder, a sand filled bladder, a foam pad, or any combination thereof.

Figure 11:
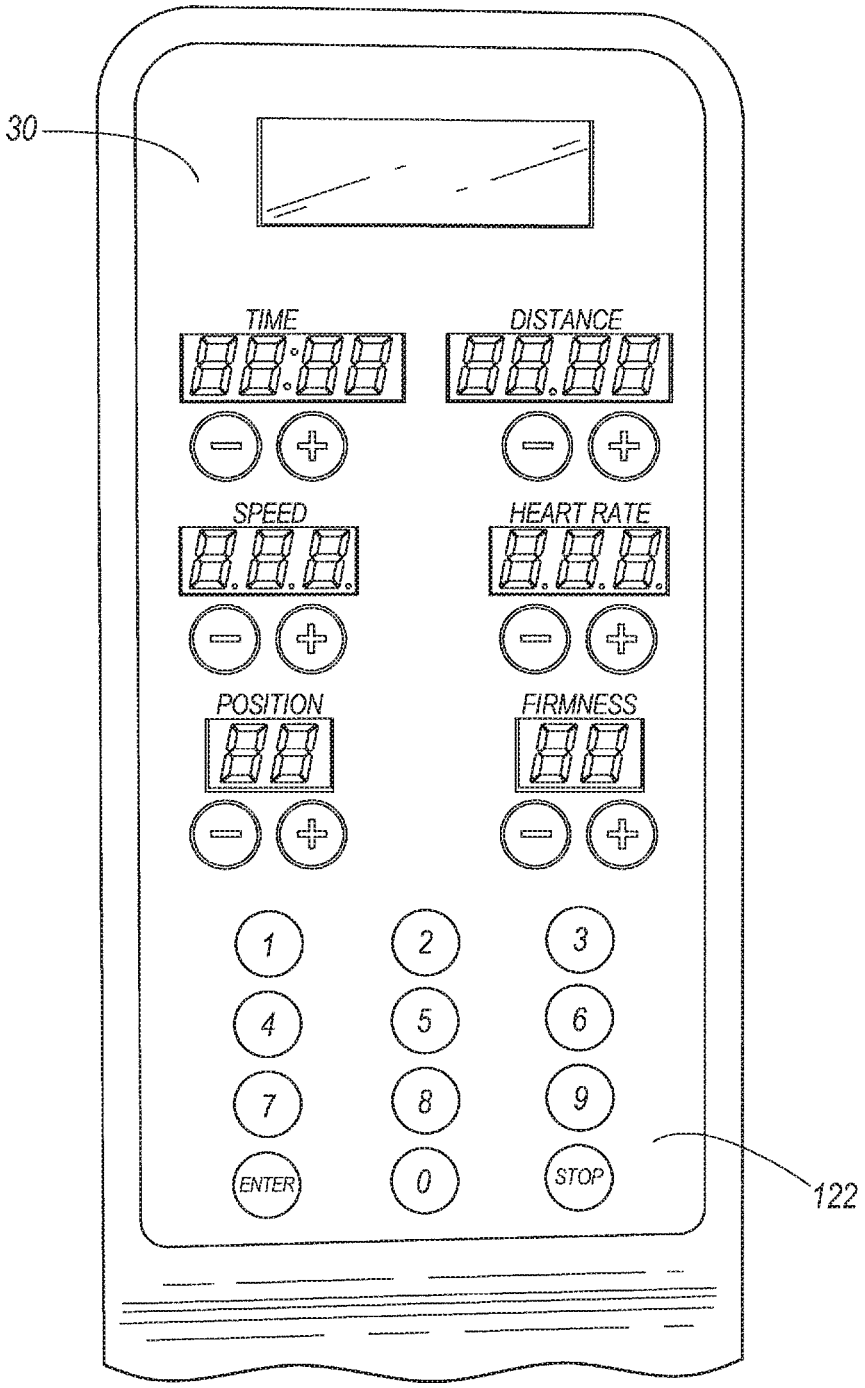
FIG. 11 is a detailed view of the control panel of the exercise apparatus of FIG. 1.

The control unit 30 provides biometric information to the user throughout the workout via a combination of numeric feedback, by displaying numerical data on a control panel 122 (see FIG. 11), and through physical feedback, by automatically altering the various forms of resistance acting on the user. The control unit 30 collects an array of sensor inputs and user inputs and enters them into a group of specifically developed algorithms to monitor the workout conditions and calculate the various forms of feedback. Some specific forms of numeric feedback may include the number of footfalls, number of footfalls per minute, elapsed time, distance traveled, calories burned, heart rate, cushion air pressure, surface angle, and the like. In some constructions, the control unit 30 may be coupled to and interact with a video screen, touch screen, video gaming system, and the like, to provide instructions, predetermined workouts, feedback to the user and allow the user to input information into the control unit.

As described above, in addition to the numeric feedback, the control unit 30 provides physical feedback in the form of altering various forms of resistance. Dependent upon the operating mode of the control unit 30, the control unit may adjust any combination of features on the apparatus 10, such as the tension in the elastic cords (e.g., through the position of the adjuster 98), the firmness of the running surface 22 (e.g., by adding or removing fluid from the bladder), and the incline of the running surface 22, among others, to provide the desired exercising conditions. Some of the operating modes of the control unit 30 may include, but are not limited to, maintaining a certain heart rate, maintaining a certain speed, maintaining a particular tension within the cords 106, or any combination thereof. Furthermore, the control unit 30 may adjust the tension, pressure, and incline randomly, or follow a pre-programmed course. In some operating modes, the user may directly adjust each of the previously discussed features manually to create a custom workout experience.

The control panel 122 utilizes a variety of displays and buttons to act as an interface with the user for both inputs and outputs. The control panel 122 typically displays numeric feedback in a combination of graphs, charts, pictures, and raw numbers. The control panel 122 is coupled to the arm rails 46 so it can be easily accessed and viewed by the user while exercising on the apparatus 10. Examples of possible user inputs include, but are not limited to, the user's weight, height, age, preferred workout duration, target speed at which the user may walk or jog, and the desired operating mode.

The control unit 30 also includes a plurality of sensors relaying inputs to the control panel 122. In the illustrated construction, the control unit 30 may include one or more tension sensors 128 to determine the tension within the cords 106, pressure sensors (not shown) to record the fluid pressure within the bladder 66 (when present), and force sensors (not shown) to determine any forces applied to the foam cushion 18*b* (when present). The tension sensors 128 are positioned between the adjuster 98 and a corresponding cord 106 (see FIG. 4*c*). In some constructions, the control unit 30 may use the fluid pressure in the bladder 66, or force exerted upon the foam cushion 18*b*, to determine the user's weight in place of requiring the user to enter it manually. In other constructions, a heartbeat sensor, either remotely worn by the user or formed integrally with the arm rails 46, may provide heartbeat information to the control panel 122.

In still other constructions, accelerometers (not shown) are coupled on or under the running surface 22 of the cushion 18. The accelerometers are sensitive to footfalls that occur on the running surface 22. The accelerometers then transmit this data to the control unit 30 which records the footfall or step. In the illustrated construction, a pair of accelerometers are used, each corresponding to the general position the user's foot is expected to land, but more or fewer accelerometers may be utilized dependent upon the sensitivity of the accelerometers themselves and the specific requirements of the apparatus 10 in which it is used.

To exercise on the cardiovascular exercise apparatus 10, the user selects one or more harnesses 94, each corresponding to a particular muscle group he or she would like to target. For example, a first harness may be placed around the torso, and second and third harnesses may be coupled to the wrists. Typically, the user will stand on the platform 58 while putting on the harnesses 94 and preparing the exercise apparatus 10. The user may then adjust the position of the pulley 102 to alter the angle at which the cords 106 will extend from his or her body (described above). After coupling the appropriate cords 106 to their respective harnesses 94 and verifying that each cord 106 extends over the pulley 102 and is secured to the adjuster 98, the user may step onto the running surface 22 using the arm rails for stability.

As the user moves forward onto the running surface 22 and away from the platform 58, the cords 106 will begin to stretch, causing a tensional force on each harness 94 and on the user. Once the user has reached a desired running location on the running surface 22, the user may begin running, jogging, or walking in place, against the tension provided from the cords 106. During the workout session, the control unit 30 may begin to automatically adjust the tension within each cord 106 by moving the adjuster 98 generally upwardly to reduce the tension and moving the adjuster 98 generally downwardly to increase the tension. Furthermore, the control unit 30 may add or remove fluid from the bladder 66 to either firm (e.g., add fluid) or soften (e.g., remove fluid) the running surface 22, thereby affecting the ease of running or walking. The control unit 30 may also record the number of footfalls by compiling the number of pressure spikes in the bladder 66, the number of acceleration spikes recorded by the accelerometers, tension spikes in the cords 106, or any combination thereof.

When the workout session is complete, the user can step back onto the platform 58, using the arm rails 46 for stability. Once on the platform 58, the user can remove any harnesses 94 and store the equipment as required.

Figure 13C:
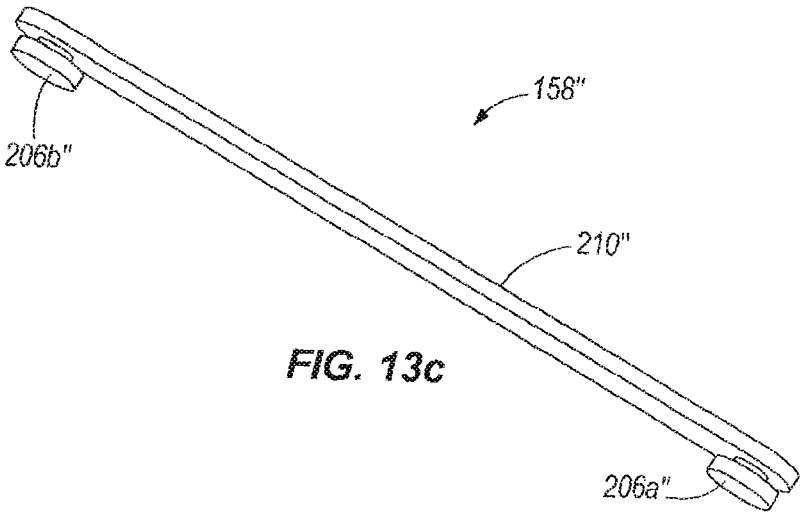
FIGS. 13*a*-13*c* illustrate an alternate embodiment of the exercise apparatus.
Figure 13A:
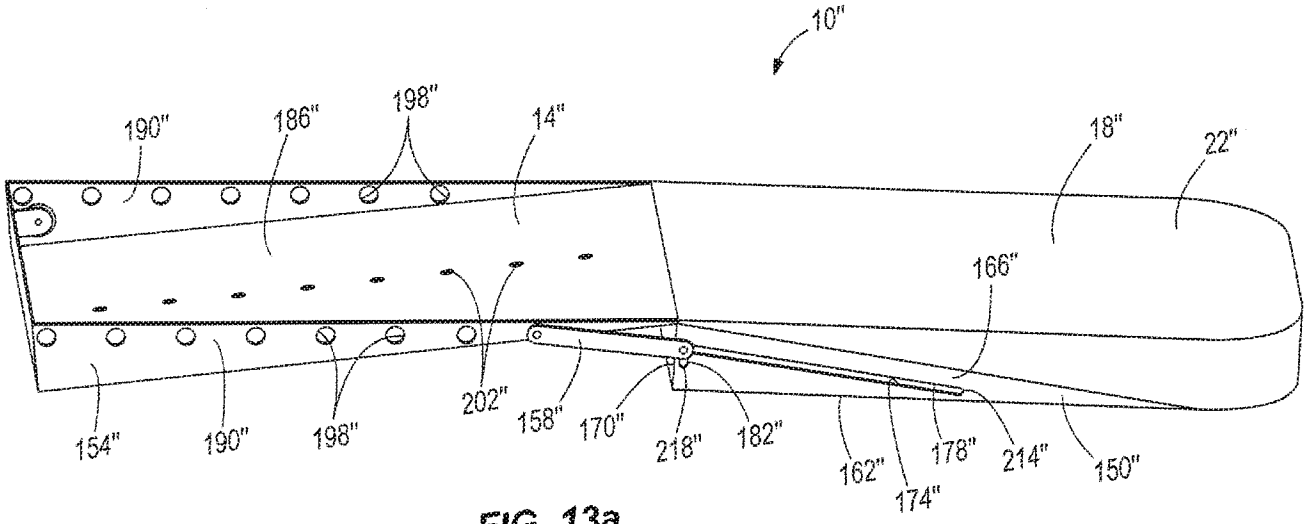
Figure 13B:
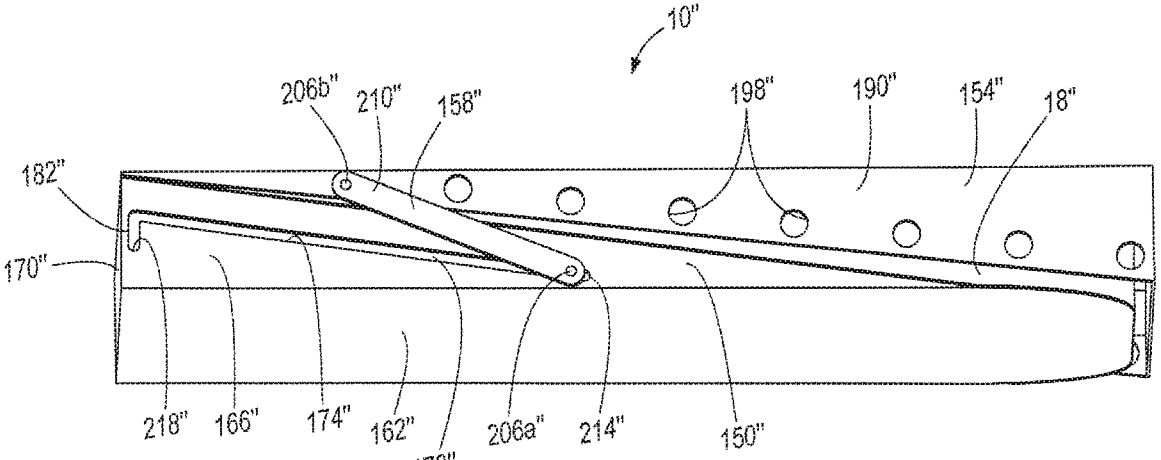

FIGS. 13*a*-13*c* illustrate a third construction 10" of the exercise apparatus adjustable between a first, deployed configuration (see FIG. 13*a*), and a second stowed configuration (see FIG. 13*b*). In the alternate construction, the apparatus 10" includes a frame 14" having a first portion 150" and a second portion 154" pivotably coupled to the first portion 150", and an intermediate member 158" extending between the first and second portions 150", 154".

The first portion 150" of the frame 14" has a bottom wall 162" suitable to rest on a support surface, a pair of side walls 166" extending substantially perpendicular to the bottom wall 162", and an end wall 170" extending between the two side walls 166" to enclose one end of the bottom wall 162". The side walls 166" and end wall 170" generally form a space shaped to receive the cushion 18", described above, on which the user is supported while exercising. In the illustrated construction, each of the side walls 166" taper as they extend away from the end wall 170".

The first portion 150" of the frame 14" also includes a pair of slots 174", each defined by a corresponding side wall 166" and substantially aligned with one another. Each slot 174" includes a first leg 178", generally extending at an angle with respect to the bottom wall 162", and a second, substantially vertical leg 182", extending downwardly from the end of the first leg 178" proximate the end wall 170".

The second portion 154" of the frame 14" is shaped similar to the first portion 150" and includes a bottom wall 186", a pair of side walls 190", and an end wall 194" positioned opposite the end of the bottom wall 186" pivotably coupled to the first portion 150". The side walls 190" generally define a first plurality of mounting apertures 198" to which one end of a cord 106, described above, may be attached during use of the apparatus 10". Similarly, the bottom wall 186" defines a second plurality of apertures 202" to which one end of a cord 106 may be attached during use of the apparatus 10". Generally speaking, the second plurality of apertures 202" are utilized as the mounting location for the cords 106 attached to the main harness 94 while the first plurality of apertures 198", defined by the side walls 190", are used as mounting locations for the cords 106 attached to the secondary or lesser aspects of the user's body (e.g., the wrist, ankles, etc.).

Illustrated in FIG. 13*c*, the intermediate member 158" includes an elongated body 210" and a first and a second mounting lug 206*a*", 206*b*", each extending from opposing ends of the body 210". When the apparatus 10" is assembled, the first mounting lug 206*a*" is received within and moveable along a slot 174" defined by the first portion 150" while the second mounting lug 206*b*" is pivotably coupled to the corresponding side wall 190" of the second portion 154". In the illustrated construction, a pair of intermediate members 158" are used, however in alternate constructions, more or fewer intermediate members may be present as necessary.

Illustrated in FIG. 13*b*, when the apparatus 10" is in the stowed configuration, the second portion 154" is folded back onto the first portion 150" to form a substantially boxlike shape. In the stowed configuration, the first and second portions 150", 154" of the frame 14" substantially encompass the cushion 18". In contrast, when the apparatus 10" is in the deployed position (see FIG. 13*a*), the second portion 154" is rotated away from the first portion 150" exposing the running surface 22" of the cushion 18" and providing access to the first and second sets of apertures 198", 202".

To exercise on the apparatus 10", the user places the stowed apparatus on a support surface, making sure the bottom wall 162" of the first portion 150" contacts the support surface. In the stowed configuration, the first mounting lug 206*e* of each intermediate member 158" is positioned proximate the first end 214" of the slot 174".

To deploy the apparatus 10", the user pivots the second portion 154" of the frame 14" with respect to the first portion 150", causing the first mounting lug 206*a*" to move along the first leg 178" of the slot 174" away from the first end 214".

As the second portion 154" approaches approximately 180 degrees of rotation, the first mounting lug 206*a*" will transition from the first leg 178" of the slot 174" to the second leg 182", at which time the lug 206*a*" drops (e.g., by gravity, a biasing member, or the like) to the bottom or second end 218" of the slot 174". Once the lug 206*a*" is positioned at the bottom of the slot 174", the apparatus 10" is in the deployed position and the second portion 154" of the frame 14" is locked with respect to the first portion 150".

The user then selects one or more harnesses 94, each corresponding to a particular muscle group he or she would like to target. The user attaches one end of each cord 106 to a corresponding harness 94, and the remaining end of the cord 106 to the appropriate aperture of either the first or second plurality of apertures 198", 202". The user may then step on the running surface 22" of the cushion 18" and exercise as described above, taking note that the tension is maintained within the cords 106 by the rigidity between the first and second portions 150", 154" of the frame 14" provided by the intermediate members 158".

To re-stow the apparatus 10", the user must first lift the first mounting lug 206*a*" from the bottom of the slot 174" to the intersection between the first and second legs 178", 182". The user may then rotate the second portion 154" of the frame 14" with respect to the first portion 150", causing the lug 206*a*" to return to the first end 214" of the slot and the apparatus 10" to return to the box-like stowed configuration. Furthermore, the apparatus 10" may be locked in the stowed position by a latch or the like.

Figure 14A:
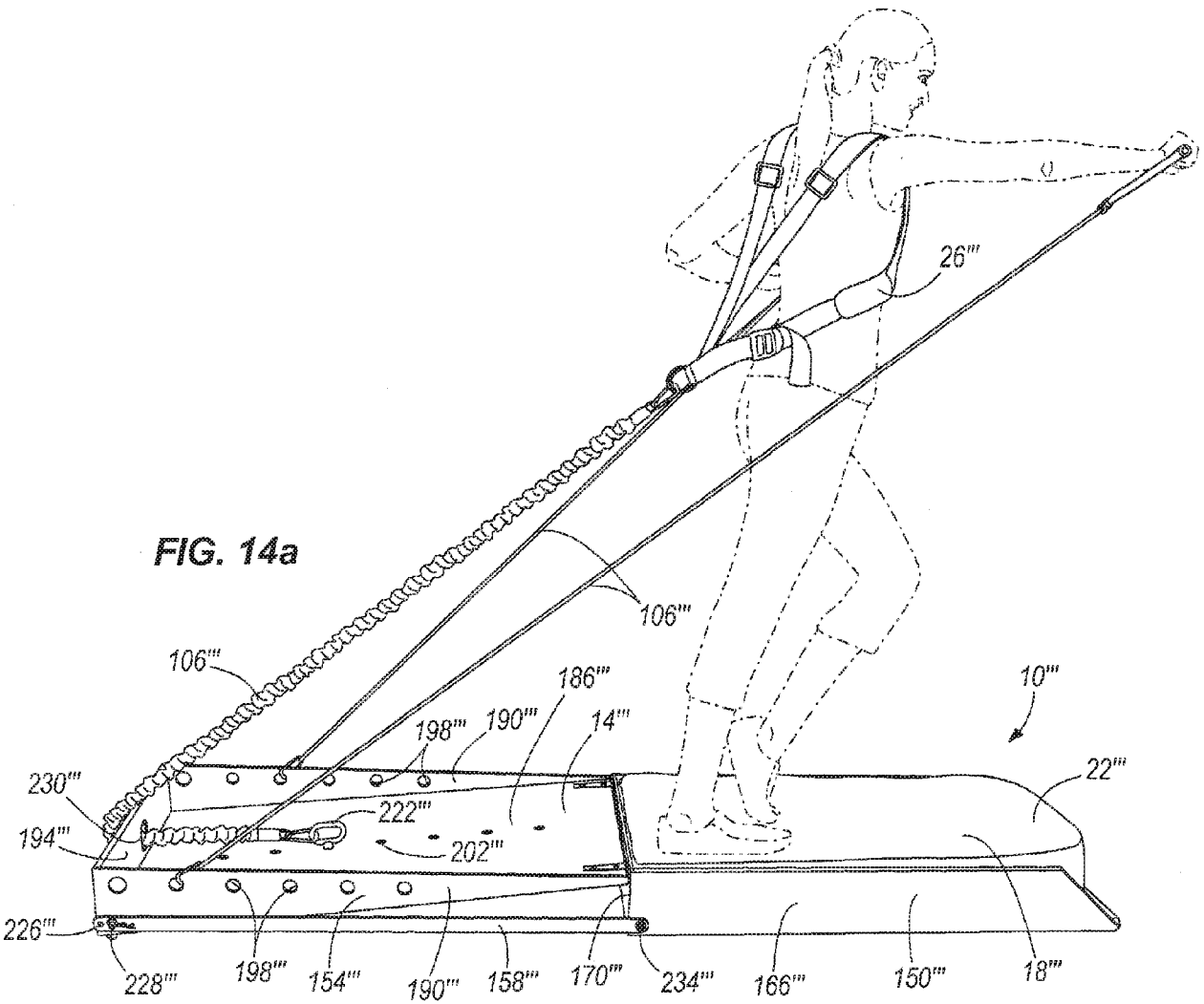
FIGS. 14*a*-14*b* illustrate an alternate embodiment of the exercise apparatus.
Figure 14B:
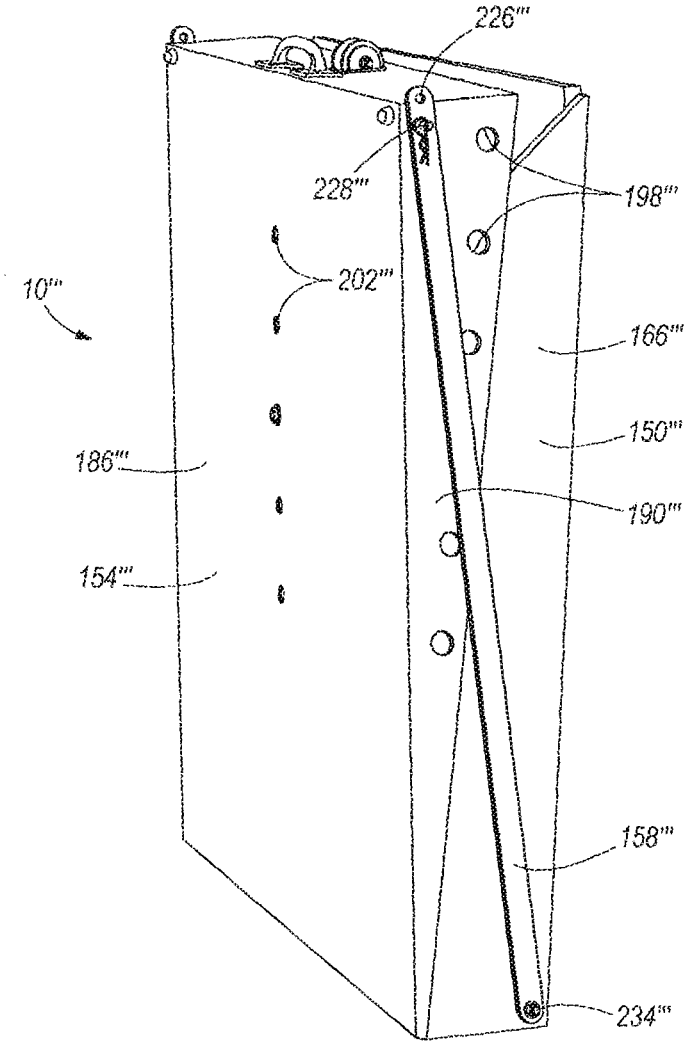

FIGS. 14*a* and 14*b* illustrate a fourth construction of the exercise apparatus. The fourth construction of the exercise apparatus 10'" employs much of the same structure and has many of the same properties as the previously-described apparatus 10" shown in FIGS. 13*a*-13*c*. Analogous elements to those of the third embodiment have been given the same number and a third prime symbol. The following description of the apparatus 10'" focuses primarily upon structure and features different than the previously-described construction.

The intermediate member 158'" of the fourth exercise apparatus 10'" includes an elongated body defining a first mounting location or aperture 234'" pivotably coupled to the first portion 150'", a second mounting location 228'" spaced a first distance from the opposing end of the body as the first mounting location 234'", and a third mounting location 226'" spaced a second distance from the opposing end of the body from the first mounting location 234'" shorter than the first. In the illustrated constructions, both the second and third apertures 228'", 226'" are couplable to a pin extending from the second portion 154'" of the frame 14'" and are positioned such that each aperture aligns with the pin in either the open configuration (see FIG. 14*a*) or the closed configuration (see FIG. 14*b*).

To deploy the apparatus 10'", the user displaces both of the intermediate members 158'" away from the frame 14'" so the pin is no longer extending through the second aperture 228'". The user pivots the second portion 154'" of the frame 14'" with respect to the first portion 150'" roughly 180 degrees until the second portion 154'" is in the open configuration (see FIG. 14*b*).

The user then aligns and inserts the pin into the third mounting location 226'" locking the frame 14'" in the open configuration.

The user then selects one or more harnesses 94'", each corresponding to a particular muscle group he or she would like to target. The user attaches one end of each cord 106'" to a corresponding harness 94'", and the remaining end of the cord 106'" is passed through an aperture 230'" formed in the end wall 194'" of the second portion 154'" and is anchored to an anchoring pin 222'" coupled to one of the apertures 202'" defined by the second portion 154'".

The user may then step on the running surface 22'" of the cushion 18'" and exercise as described above, taking note that the tension is maintained within the cords 106'" due to the rigidity between the first and second portions 150'", 154'" of the frame 14'" provided by the intermediate members 158'".

To re-stow the apparatus 10'", the user displaces both the intermediate members 158" away from the frame 14'" so the pin is no longer extending through the third aperture 226'". The user pivots the second portion 154'" of the frame 14'" with respect to the first portion 150'" roughly 180 degrees until the second portion 154'" is in the closed position (see FIG. 14*b*). The user then aligns and inserts the pin into the second aperture 228'" locking the frame in the closed configuration.

Although not illustrated, alternate forms of locking may be used to maintain the first and second portions 150'", 154'" in the open and closed configurations.

The invention claimed is:

1. A method of cardiovascular exercise for a user comprising:

engaging a harness of an exercise device, the harness being secured to a frame of the exercise device by a tensionable resistance member of the exercise device;

stepping onto a surface of a non-movable cushion of the exercise device to a location to impose a tension within the tensionable resistance member; and running on the cushion, the tension imposed within the tensionable resistance member by the user during the running maintaining the runner on the cushion and the cushion remaining stationary relative to the frame during the running.

2. The method of claim 1, further including placing the cushion adjacent a rigid structure prior to the stepping, the rigid structure maintaining the cushion stationary relative to the rigid structure during the running.

3. The method of claim 1, further including placing the cushion within an opening defined by the frame prior to the stepping, the frame maintaining the cushion stationary relative to the frame during the running.

4. The method of claim 1, further including placing the cushion adjacent a wall prior to the stepping, the wall maintaining the cushion stationary relative to the wall during the running.

5. The method of claim 1, wherein the engaging includes wearing the harness.

6. The method of claim 1, wherein the harness is a belt and the engaging includes wearing the belt.

7. The method of claim 1, including varying the tension of the tensionable resistance member with a tension adjuster prior to the running.

8. The method of claim 7 wherein the varying does not include adding weight to or removing weight from the exercise device.

9. The method of claim 1, including varying the tension of the tensionable resistance member with a tension adjuster secured to an upright of the frame.

10. The method of claim 1, further comprising securing one or more additional tensionable resistance members to the user and the frame, the user imposing a tension within the additional tensionable resistance member during the running.

11. The method of claim 1, further comprising securing an additional tensionable resistance members to a wrist of the user and the frame, the user imposing a tension within the additional tensionable resistance member during the running.

12. The method of claim 1 further including removing the cushion and replacing it with another non-moving cushion.

13. A method of cardiovascular exercise for a user comprising:

engaging a harness of an exercise device, the harness being secured to a frame of the exercise device by a tensionable resistance member of the exercise device;

stepping onto a surface of a non-movable cushion of the exercise device to a location to impose a tension within the tensionable resistance member, the cushion comprising at least one fluid filled bladder;

running on the cushion, the tension imposed within the tensionable resistance member by the user during the running maintaining the runner on the cushion and the cushion remaining stationary relative to the frame during the running.

14. The method of claim 13, further including placing the cushion adjacent a rigid structure prior to the stepping, the rigid structure maintaining the cushion stationary relative to the rigid structure during the running.

15. The method of claim 13, further including placing the cushion within an opening defined by the frame prior to the stepping, the frame maintaining the cushion stationary relative to the frame during the running.

16. The method of claim 13, further including placing the cushion adjacent a wall prior to the stepping, the wall maintaining the cushion stationary relative to the wall during the running.

17. The method of claim 13, wherein the engaging includes wearing the harness.

18. A method of cardiovascular exercise for a user comprising:

wearing a harness of an exercise device, the harness being secured to a frame of the exercise device by a tensionable resistance member of the exercise device;

stepping onto a non-movable cushion of the exercise device to impose a tension within the tensionable resistance member, the cushion being received by an opening defined by the frame of the exercise device;

running on the cushion, the tension imposed within the tensionable resistance member by the user during the running maintaining the runner on the cushion and the cushion remaining stationary relative to the frame during the running.

* * * * *